US005413352A

United States Patent [19]

Persidsky et al.

[11] Patent Number: 5,413,352

[45] Date of Patent: May 9, 1995

[54] SELF-SETTING GAME BOARD DEVICE

[76] Inventors: Andre M. Persidsky; Maxim D. Persidsky, both of 35 Temescal, San Francisco, Calif. 94118

[21] Appl. No.: 118,444

[22] Filed: Sep. 7, 1993

[51] Int. Cl.[6] ..... A63F 3/02

[52] U.S. Cl. ..... 273/287; 273/239; 273/282.1; 273/283; 273/285; 273/260

[58] Field of Search ..... 273/260, 239, 287, 283, 273/148 R, 285, 282.1

[56] References Cited

U.S. PATENT DOCUMENTS

| | | | |
|---|---|---|---|
| 2,221,267 | 11/1940 | Robertson | 273/285 |
| 2,511,774 | 6/1950 | Goldsmith | 273/287 |
| 5,244,212 | 9/1993 | Bendit | 273/239 |

FOREIGN PATENT DOCUMENTS

| | | | |
|---|---|---|---|
| 35239 | 4/1886 | Austria | 273/285 |
| 1163871 | 6/1985 | U.S.S.R. | 273/260 |

*Primary Examiner*—Benjamin H. Layno
*Attorney, Agent, or Firm*—Flehr, Hohbach, Test

[57] ABSTRACT

The present invention relates to a game board device, more specifically to a chessboard game device having self-setting capability for its game pieces. Disclosed are five different embodiments of chessboard game devices having the capability of automatically setting-up chess pieces on their chessboards. The third preferred embodiment has a chessboard with a magnetically attractive surface covered by a chessboard sticker, and two holders on either side of a game box, with 16 compartments arranged in two rows of eight in each holder. Each holder contains either black or white chess pieces in its compartments in an inverted position and each chess piece has a magnet disposed in its base. The compartments are arranged to match the starting positions on the chessboard, so that when the chessboard is placed upside-down over the holders, the magnetic bases of the inverted chess pieces make contact with the appropriate squares on the chessboard, and are magnetically attached. When the chessboard is raised, the chess pieces are lifted together with the chessboard out the their compartments. The chessboard is then rotated 180 degrees by hand into its upright position and placed on a tabletop. During play, captured chess pieces are immediately deposited upside-down Into their appropriately labeled compartments as a process for preparing the chessboard to be reset for the next game.

The first and second embodiments utilize a split chessboard design where each chessboard half lifts inverted magnetic chess pieces by pivoting action. The fourth and fifth embodiments do not require magnetic attachment means.

32 Claims, 9 Drawing Sheets

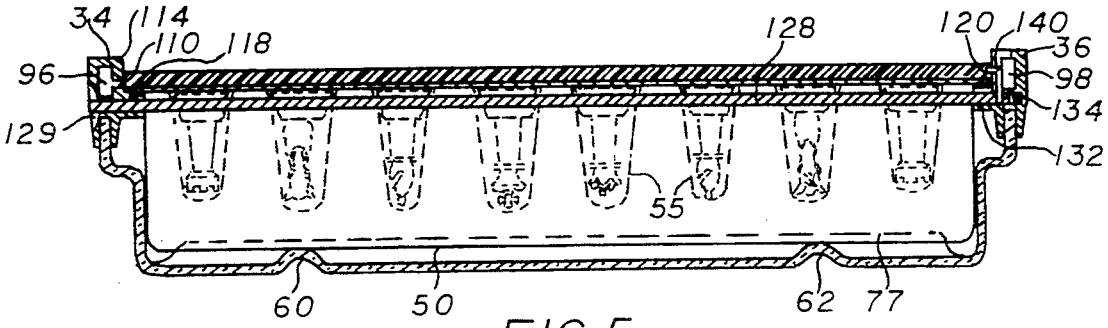
FIG. 5
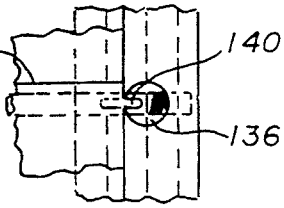
FIG. 5B
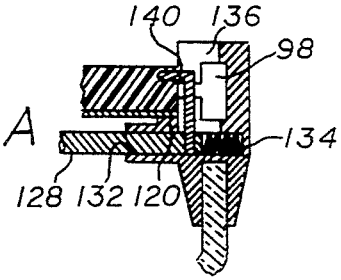
FIG. 5A
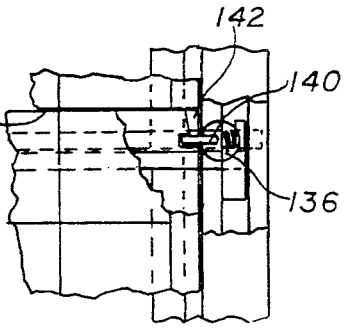
FIG. 6
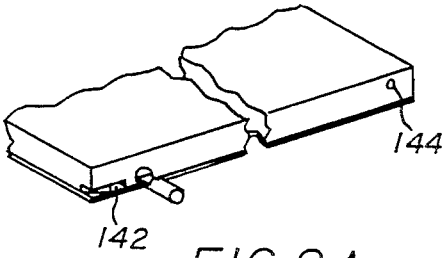
FIG. 8A
FIG. 7
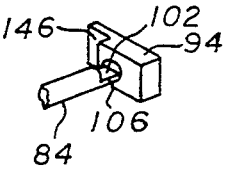
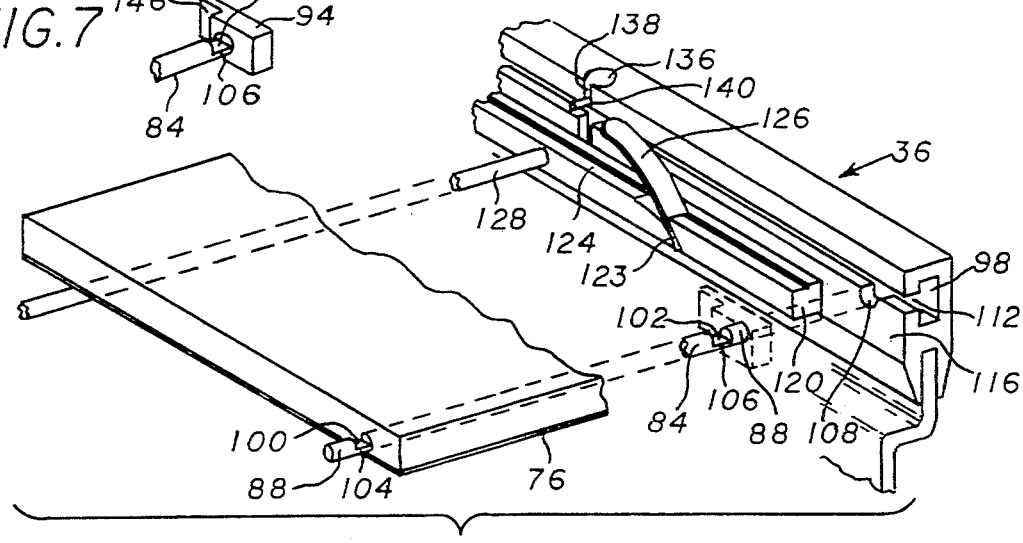
FIG. 8

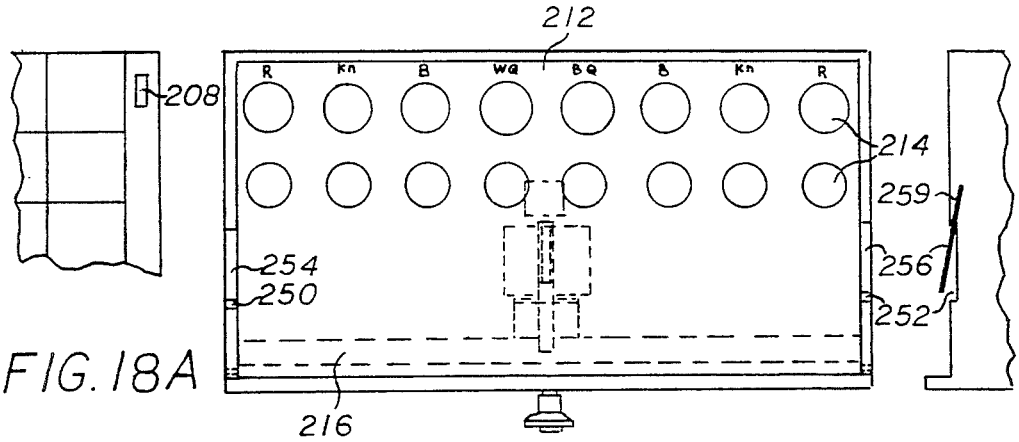
FIG. 18A
FIG. 18
FIG. 18B
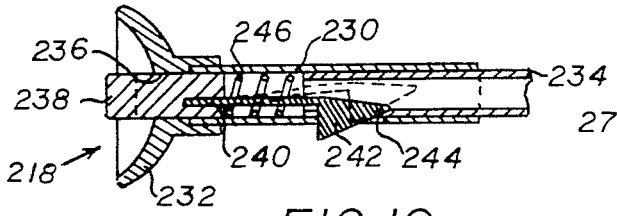
FIG. 19
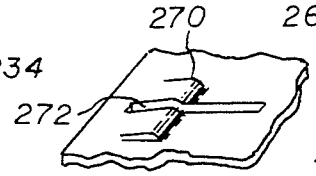
FIG. 20
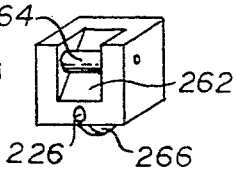
FIG. 21
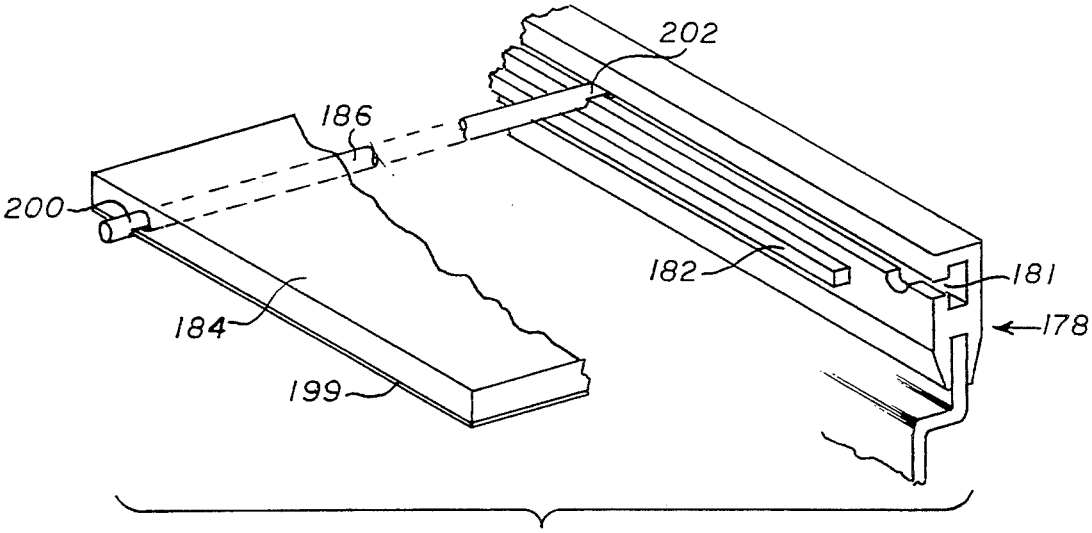
FIG. 22
FIG. 23
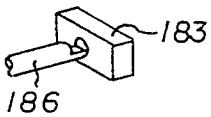

SELF-SETTING GAME BOARD DEVICE

BACKGROUND—FIELD OF INVENTION

This invention relates to a game board device that has the provision for automatically setting up game pieces on its game board. More particularly, this invention relates to a chessboard game device that has the means for automatically setting up chess pieces on its chessboard.

BACKGROUND DESCRIPTION

A needless effort the chess player must face before the start of each game is the tedious routine of manually setting up chess pieces on the chessboard. This effort can be further aggravated by the scattering of the chess pieces around the playing area during the game, adding to the length of time needed to arrange the chess pieces for a new game. In addition, the chess pieces are often improperly arranged on the chessboard, for example, the positions of the king and queen being reversed. Discovering such a mistake after a game has begun can lead to confusion.

The present invention greatly reduces the aforementioned problems related to manually setting up a chessboard, by prodding a self-setting chessboard game device that has the means for automatically setting up chess pieces on its chessboard.

OBJECTS AND ADVANTAGES

Accordingly, several objects and advantages of our invention are:

- to minimize the conventional manual efforts and time involved in setting up a chessboard by providing the mechanical means for automatically setting up chess pieces on a chessboard;
- to minimize the scattering, loss, and damage of chess pieces by providing a self-setting chessboard game device where the players immediately deposit each captured chess piece into holders during play;
- to ensure the proper arrangement of chess pieces on a chessboard thus preventing needless delays and confusion in rearranging chess pieces before and during a game by providing a self-setting chessboard game device with holders containing appropriately arranged and labeled compartments into which chess pieces are deposited;
- to help beginners learn the proper arrangement of chess pieces on a chessboard, and to increase motivation for playing chess by providing a preset chessboard.

Additional objects and advantages of our invention will become apparent from a consideration of the drawings and ensuing description.

SUMMARY

The self-setting chessboard game device of this invention provides the means for automatically setting up chess pieces on its chessboard. The description of this invention exemplifies five embodiments which each accomplish the self-setting process through various mechanical means. These five embodiments make use of chess piece holders, each having a plurality of compartments in predetermined positions matching the starting positions of the chess pieces on the chessboard. During play, captured chess pieces are deposited into these holders as they are removed from the chessboard. The remaining chess pieces on the chessboard after a game are also deposited into these holders. To reset the chessboard, the filled holders are placed against the chessboard, where the chess pieces are released and set in their appropriate starting positions. This invention provides a number of advantages over conventional chess game boards: this includes reducing the manual efforts and time involved in setting up a chessboard; minimizing the scattering, loss, and damage of chess pieces; ensuring the proper arrangement of chess pieces on the chessboard; increasing motivation for playing chess by providing a preset chessboard;

DRAWINGS FIGURES

FIG. 5 is a cross sectional and cutaway view taken along lines 5—5 in FIG. 2;

FIG. 5A is a fragmentary enlarged sectional view of a locking rod and rail in the closed position of the self-setting chessboard game device;

FIG. 5B is a top plan fragmentary view of a locking rod and spring in the closed position of the self-setting chessboard game device;

FIG. 6 is a fragmentary top plan partially cutaway view of a chessboard half in the locked playing position of the self-setting chessboard game device;

FIG. 7 is a perspective view of a bar pivotely connected to an end of a chessboard shaft;

FIG. 8 is a perspective fragmented and partially exploded view of a rail in relation to a chessboard half in the closed position of the self-setting chessboard game device;

FIG. 8A is a perspective fragmentary view of the right side of a chessboard half;

FIG. 18 is a top plan view of a drawer with its chess pieces holder plate;

FIG. 18A is a fragmented top elevational view illustrating a groove in a chessboard half;

FIG. 18B is a fragmented side plan view of a drawer illustrating a flat spring;

FIG. 19 is an enlarged longitudinal fragmented and sectional view of a locking handle;

FIG. 20 is a perspective fragmented view of an indentation and cam groove;

FIG. 21 is a perspective view of a cube with a cam and a roller;

FIG. 22 is a perspective fragmented view of a rail in relation to a chessboard half in the closed position of the self-setting chessboard game device;

FIG. 23 is a perspective view of a bar connected to an end of a chessboard shaft;

Figure 37:
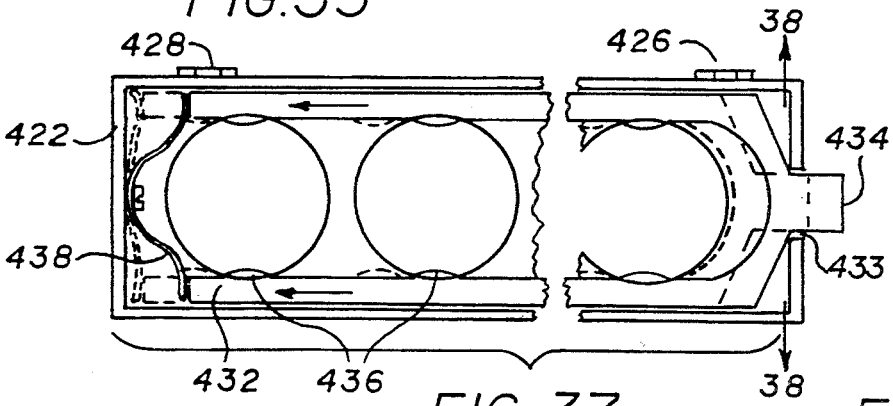
Figure 38:
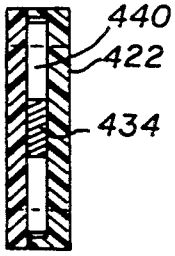
Figure 39:
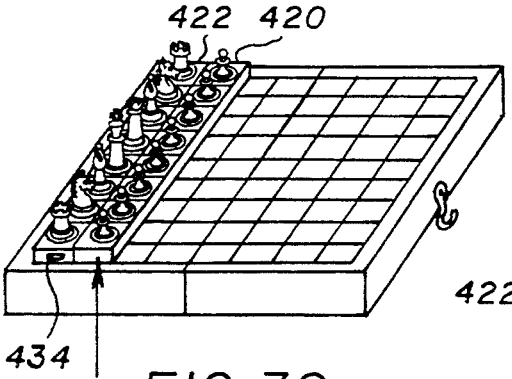
Figure 40:
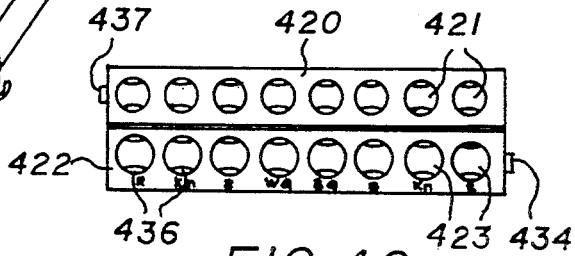

FIG. 37 in an enlarged fragmented and cutaway view of the compartments and locking fork of a holder half;

FIG. 38 is a cross sectional and cutaway view taken along lines 38—38 in FIG. 37;

FIG. 39 is a perspective view of an open chess box with an opened chess piece holder;

FIG. 40 is a top plan view of the compartments of an opened chess piece holder;

DESCRIPTION OF THE FIRST EMBODIMENT

While this invention is susceptible of embodiment in many different forms, there are shown in the drawings and will be described in detail, five embodiments of the invention. It should be understood however, that the present disclosure is to be considered as an exemplification of the principles of the invention and is not intended to limit the invention to the embodiments illustrated.

Figure 1:
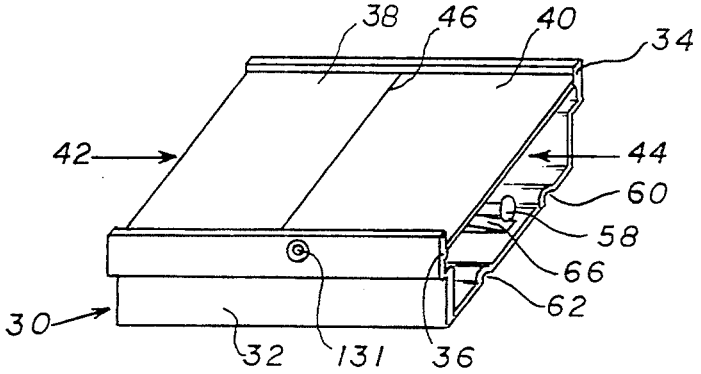
FIG. 1 is a perspective view of the first embodiment of a self-setting chessboard game device in the closed position.
Figure 2:
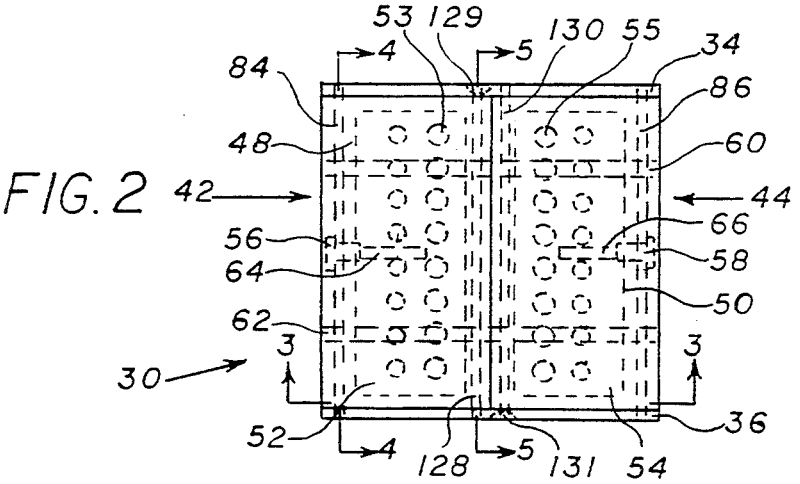
FIG. 2 is a top plan view of a closed self-setting chessboard game device.

Referring to FIGS. 1 and 2, a self-setting chessboard game device or chess box 30 is shown in the closed position. Chess box 30 consists of two structurally identical sides, with a center dividing line 46. Chess box 30 consists of a trough 32 having open ends on opposite sides. Attached to trough 32 are identical chess box rails 34 and 36 shown in greater detail in FIG. 4. Trough 32 is preferably constructed out of a plastic material and chess box rails 34 and 36 are constructed preferably out of aluminum. The upper surface enclosing chess box 30 consists of the back surfaces 38 and 40 of the respective identical and separate chessboard halves or board halves 42 and 44 with center dividing line 46 formed where the two boards halves 42 and 44 meet. Board halves 42 and 44 are each supported by chess box rails 34 and 36.

Figure 3A:
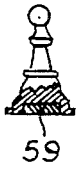
FIG. 3 is a cross sectional and cutaway view taken along lines 3—3 in FIG. 2.
Figure 3:
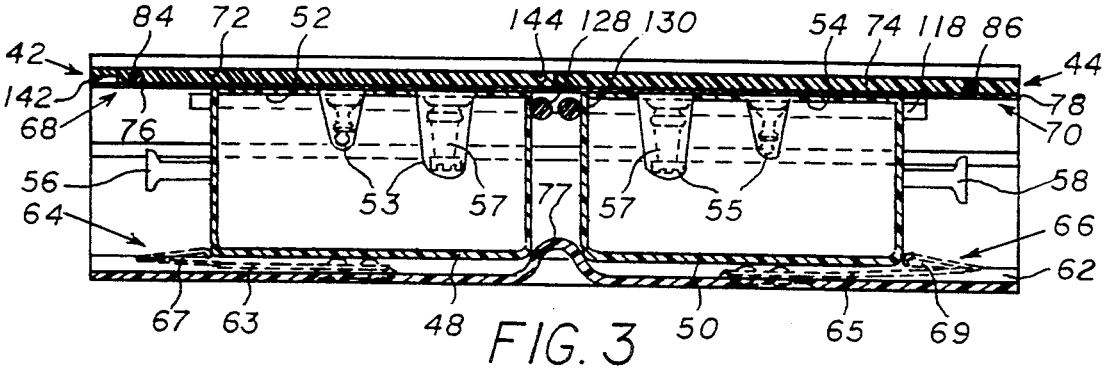
Figure 4:
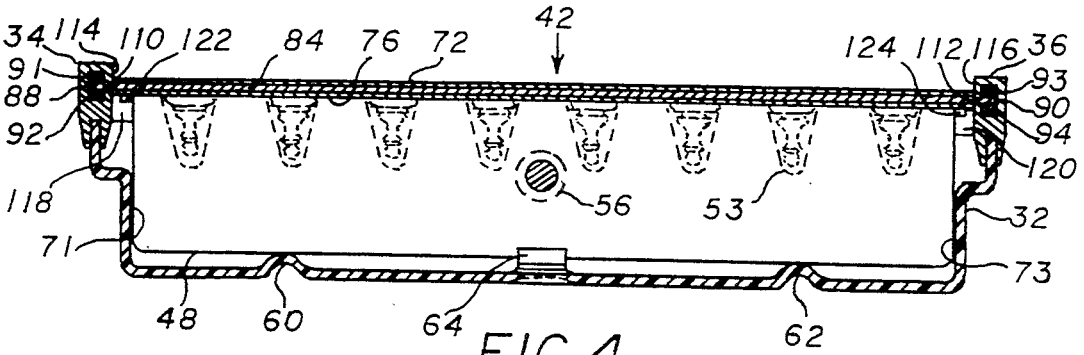
FIG. 4 is a cross sectional and cutaway view taken along lines 4—4 in FIG. 2.

As indicated by phantom lines in FIG. 2, chess box 30 contains two rectangular drawers 48 and 50. Drawers 48 and 50 are also visible in cross sectional view in FIG. 3, and in a top plan view in FIG. 12 where they have been removed from chess box 30. A frontal view of drawer 48 is shown in FIG. 4. Drawers 48 and 50 are preferably made of plastic material. The upper side of each drawer is covered by chess piece holder plates or holder plates 52 and 54, preferably made of plastic shown in FIG. 2. Holder plates 52 and 54 have compartments 53 and 55, shown in FIG. 3. Compartments 53 and 55 are conical in shape and are each arranged in two rows, with 8 compartments per row, for holding chess pieces 57 in an upside down position, shown from the top in FIG. 12, and in sectional and cutaway views in FIGS. 3, 4, and 5. Each chess piece 57 has a cylindrical magnet 59 positioned in its base as shown sectionally in FIG. 3A. The top rows of compartments 53 and 55 are labeled by abbreviated chess piece names 61, R for rook, Kn for knight, B for bishop, WQ for white queen, and BQ for the black queen, shown in FIG. 12. The reason that there are two queen labels (WQ—white queen, BQ—black queen) and no king label for each holder plate 52 and 54 is to make drawers 48 and 50 interchangeable. For example, in FIG. 12, if drawer 48 is put in the place of drawer 50, the orientation of the white queen with respect to the chessboard remains the same, that is, the white queen is still four squares from the left in the top row of the drawer. The king label is omitted but he is placed after a game into the queen compartment which is not occupied by the queen. The bottom rows of compartments 53 and 55 contain the pawns of chess pieces 57 and are not labeled. Compartments 53 and 55 are of appropriate size to accommodate the different size of chess pieces 57, and the compartment walls are very thin as shown in FIGS. 3 and 5. Drawers 48 and 50 have handles 56 and 58 (FIG. 3) attached to their front side. At the bottom of trough 32, there are two drawer rails 60 and 62 shown in FIGS. 1, 2, and 4, upon which drawers 48 and 50 slide. Drawer rafts 60 and 62 also function to strengthen trough 32, and provide clearance for drawer locks 64 and 66 shown with phantom lines in FIG. 2, and in FIG. 3. Drawer locks 64 and 66 each consists of a flat spring 63 and 65 attached to the bottom of trough 32. Flat springs 63 and 65 have triangular catches 67 and 69 at their free ends, functioning to prevent drawers 48 and 50 from sliding out by catching the bottom edges of the front walls of the drawers shown in FIG. 3. Drawers 48 and 50 are prevented from horizontally sliding during removal by guide walls 71 and 73, and by ledges 118 and 120 shown in FIG. 4. Trough 32 has a center ridge 77 traversing the width of chess box 30 shown in FIG. 3. Center ridge 77 stops drawers 48 and 50 near the center of chess box 30, and also functions to strengthen trough 32.

Figure 10:
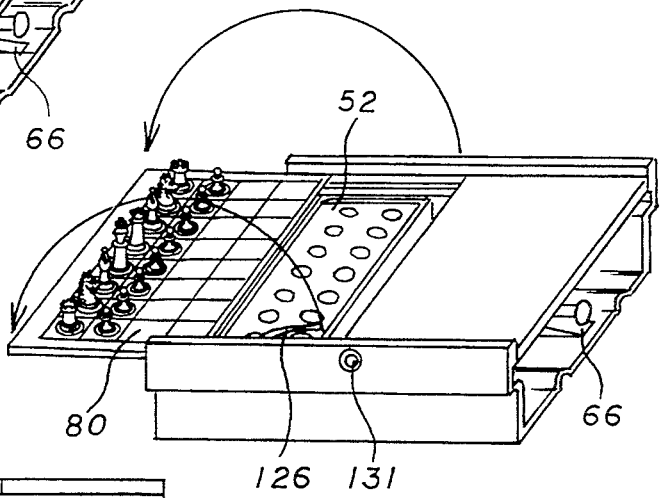
FIG. 10 is a perspective view of a self-setting chessboard game device with one of the chessboard halves rotated 180 degrees as shown by the arrows with the chess pieces set in place.

In the closed position of chess box 30, the playing sides 68 and 70 of board halves 42 and 44 face downwards against holder plates 52 and 54 of drawers 48 and 50 as shown in FIG. 3. The board halves 42 and 44 each consist of a rectangular plastic sheet 72 and 74 to which are attached thin rectangular steel sheets 76 and 78. Steel sheets 76 and 78 are attached to the playing sides 68 and 70 of boards halves 42 and 44 and each steel sheet is of the same size as its corresponding plastic sheet. The outer surfaces of steel sheets 76 and 78 are covered by chessboard stickers 80 and 82 each carrying one half of the chessboard pattern shown in FIGS. 10, 11, and 12. Stickers 80 and 82 each covers the entire surface of its corresponding steel sheet and each sticker carries 32 checker squares and has borders on three of its sides. Chessboard stickers 80 and 82 are positioned on steel sheets 76 and 78 so that the centers of compartments 53 and 55 below line up with the centers of the appropriate squares on the stickers. In the closed position of chess box 30, inverted chess pieces 57 are magnetically attached to steel sheets 76 and 78, onto the centers of the corresponding squares of chessboard stickers 80 and 82 shown in FIG. 5. At the outer ends of each board half 42 and 44 there are fixedly attached metal chessboard shafts 84 and 86 embedded into plastic sheets 72 and 74 as shown in cross sectional view in FIG. 3. Shafts 84 and 86 traverse the width of each board half 42 and 44 as shown in sectional view for board half 42 in FIG. 4. Shafts 84 and 86 protrude on both sides of each board half as shown for shaft 84 in FIG. 8. The protruding fixed ends of shaft 84 form pivots 88 and 90 around which board half 42 can rotate. Shaft 86 of board half 44 has similar pivots (not shown). Pivots 88 and 90 are shown in sectional view in FIG. 4 protruding from both sides of board half 42 and entering holes 91 and 93 of rectangular bars 92 and 94. FIG. 7 shows pivot 90 residing in hole 93 of bar 94. Holes 91 and 93 provide the bearings around which shaft 84 with its attached board half 42 rotate as shown in FIG. 10. The other Board half 44 also has two similar bars pivotely attached to its shaft to form the same pivoting arrangement as for board half 42 (not shown).

Bars 92 and 94 are contained by and slide in channels 96 and 98 of chess box rails 34 and 36. Channels 96 and 98 are shown in FIG. 5 and channel 98 is also shown in FIGS. 5A and 8. Channels 96 and 98 traverse the entire lengths of chess box rails 34 and 36. Channels 96 and 98 are both closed off at each of their ends so as to prevent bars 92 and 94 from sliding out. In FIG. 8 though, channel 98 is shown open at its end for the purpose of clarity. Channels 96 and 98 are T-shaped in cross section, and have open slots or channel slots 110 and 112 along the inner walls 114 and 116 of their respective chess box rails 34 and 36 as shown in FIG. 4 and partially in FIG. 8. Channel slots 110 and 112 traverse the entire length of their chess box rafts 34 and 36 and these slots are equal in height to the radius of chessboard shafts 84 and 86. The bars used with board half 44 are identical to bars 92 and 94 of board half 42 and also slide in channels 96 and 98 at the opposite half of chess box 30 (not shown). A section near each pivot 88 and 90 of chessboard shaft 84 is cutout to form semi-cylindrical gaps 100 and 102 and semi-cylindrical portions 104 and 106 as shown in FIG. 8. Chessboard shaft 86 has identical semi-cylindrical gaps and portions similarly positioned next to each pivot (not shown). In the closed position of chess box 30, semi-cylindrical portion 106 (FIG. 8) of chessboard shaft 84 faces downwards and is contained by a semi-cylindrical indentation 108 in inner wall 116, situated at the outer end of chess box raft 36. Semi-cylindrical indentation 108 is positioned so that the central axes of shaft 84 lies in the plane of the bottom surface of channel slot 112 of chess box rail 36 as shown in FIG. 4 and in a partially exploded view in FIG. 8. Semi-cylindrical portion 104 of chessboard shaft 84 is also similarly contained by a semi-cylindrical indentation in inner wall 114 of chess box rail 34 (not shown). The semi-cylindrical portions of shaft 86 of the other chessboard half 44 are also each similarly contained by a semi-cylindrical indentation, one in each inner wall of each chess box rail (not shown). Ledges 118 and 120 are attached to inner walls 114 and 116 of chess box rails 34 and 36 as shown in FIG. 4. Board halves 42 and 44 can slide along these ledges as shown for board half 42 in FIG. 11. The outer ends of ledges 118 and 120 are cut out to provide room for the rotation of board halves 42 and 44 as shown for ledge 120 in FIG. 8 for board half 42.

Ledges 118 and 120 have inner steps 122 and 124 shown in FIG. 4 and partially shown in FIG. 8. Inner steps 122 and 124 traverse the lengths of ledges 118 and 120. Inner step 124 of ledge 120 holds a flat spring 126, (FIG. 8) secured at one end by being pressed into a diagonal slot 123 made in inner step 124. In both the closed and playing position of chess box 30, flat spring 126 is depressed by board half 42 so that it is flush with the surface of the top step of ledge 120. Inner step 122 of ledge 118 also has a flat spring similarly positioned on the side of board half 44 (not shown).

Chess box 30 contains two locking rods 128 and 130 (see FIG. 2), functioning to secure board halves 42 and 44 in place. Locking rods 128 and 130 are centrally positioned as shown in cross section in FIG. 3, and each spans the width of chess box 30. Locking rod 128 is shown in longitudinal cross section in FIG. 5. Chess box rafts 34 and 36 contain button recesses 129 and 131 (FIG. 2) which house the ends of locking rods 128 and 130. Button recess 129 is formed below channel 96 and goes all the way through ledge 118 as shown in FIG. 5. A hole 132 is located in chess box raft 36 directly on the opposite side of button recess 129. Hole 132 goes through ledge 120 and partially through chess box rail 36 below channel 98, shown in detail in FIG. 5A. Hole 132 contains a helical spring 134. The end of locking rod 128 is contained in hole 132 and presses against helical spring 134. The top surface of chess box rail 36 has a vertical hole 136 (FIG. 5B), positioned so that it intersects with hole 132, and forms a vertical slot 138 at the edge of inner wall 116, shown in FIG. 8 and shown sectionally in FIG. 5A. A hook 140 is contained in vertical hole 136 (FIG. 5A) and is attached to the end of locking rod 128 below. Hook 140 protrudes out of slot 138 and prevents helical spring 134 from pushing locking rod 128 out of hole 132 by catching ledge 120. Board half 42 has a locking slot 142 and a locking hole 144 in its right side wall shown in FIG. 8A. In the closed position of chess box 30, hook 140 rests in locking hole 144, securing board half 42 in place as shown in FIG. 5A and FIG. 5B. In the playing position of chess box 30, hook 140 rests in locking slot 142 (FIG. 6) which is shaped so as to allow hook 140 to temporarily recede into channel 98 while board half 42 is being slid along ledge 120 into the locked playing position. A cutout 146 is made in bar 94 to accommodate hook 140 as it temporarily recedes into channel 98 while entering locking slot 142 (FIGS. 6, 7). The locking mechanism for board half 44 with locking rod 130 is identical to that of board half 42 with locking rod 128 (not shown).

Operation of the First Embodiment

Figure 9:
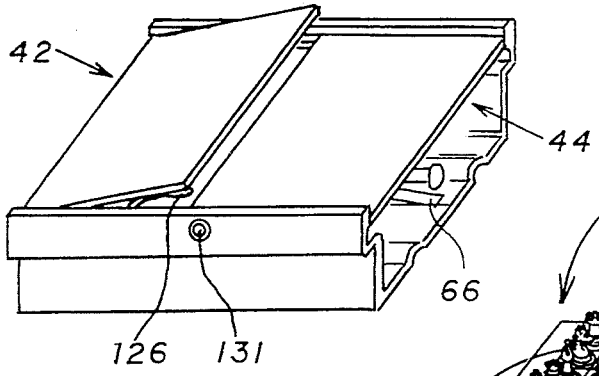
FIG. 9 is a perspective view of a self-setting chessboard game device with one of the chessboard halves partially open.

Chess box 30 has two structurally identical and independently operated halves each controlled by one of the two players. In FIG. 9, board half 42 is unlocked by pressing the protruding end of locking rod 128, positioned in button recess 129 shown in FIG. 5. This action pushes hook 140 out of locking hole 144 and into channel 98 thus allowing flat spring 126 (FIG. 8) to elevate board 42 into the position shown in FIG. 9. The player then grabs the corners of the elevated side of board half 42 and rotates it 180 degrees around pivots 88 and 90 into the position shown in FIG. 10. Since chess pieces 57 are magnetically attached upside down to steel sheet 76 of board half 42 (FIG. 3), rotating board half 42 (FIG. 10) lifts chess pieces 57 out of their compartments 53. This action constitutes the self-setting process here.

The semi-cylindrical indentations, such as semi-cylindrical indentation 108, permit shafts 84 and 86 of board halves 42 and 44 to rotate around their pivots while preventing sliding motion of shafts 84 and 86 along channel slots 110 and 112 when the semi-cylindrical portions of the shafts are partially or completely contained in the semi-cylindrical indentations as shown partially for shaft 84 in FIG. 8. This is important since it prevents a partially rotated board half 42 for instance from sliding underneath ledge 120 whereupon damage from leverage to the board half could be sustained. However, when board half 42 is rotated 180 degrees from the closed position of chess box 30 as in FIG. 10, so that the board halls playing side faces upwards, semi-cylindrical portions 104 and 106 of its fixedly attached shaft will also be rotated into an upward position completely out of the semi-cylindrical indentations and into channel slots 110 and 112. Since channel slots 110 and 112 are equal in height to the radius of chessboard shafts 84 and 86, semi-cylindrical portions 104 and 106 of shaft 84 can now slide freely along these slots, permitting bars 92 and 94 to slide in channels 96 and 98, while carrying board half 42 along with them as is the case in FIG. 11. When the semi-cylindrical portions of the chessboard shafts are in the channel slots and away from the semi-cylindrical indentations, the shafts can no longer rotate and the board halves are fixed in a horizontal position while they are being slid on ledges 118 and 120.

Figure 11:
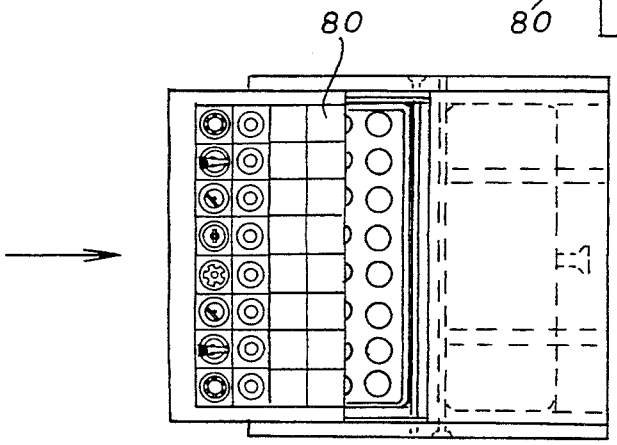
FIG. 11 is a top plan view of FIG. 10, with the open chessboard half partially inserted as shown by the arrow.

In FIG. 11, the player slides board half 42 into the locked playing position. Board half 42 is shown in the locked playing position in FIG. 6. As board half 42 enters this position, hook 140 enters the angled locking slot 142 which temporarily presses it through vertical slot 138 into channel 98. As board half 42 slides forward, helical spring 134 then pushes locking rod 128 causing attached hook 140 to be pushed out of channel 98 and into its final locked state in FIG. 6. Cutout 146 in bar 94 accommodates hook 140 as it temporarily recedes into channel 98 shown in FIGS. 6 and 7.

Figure 12:
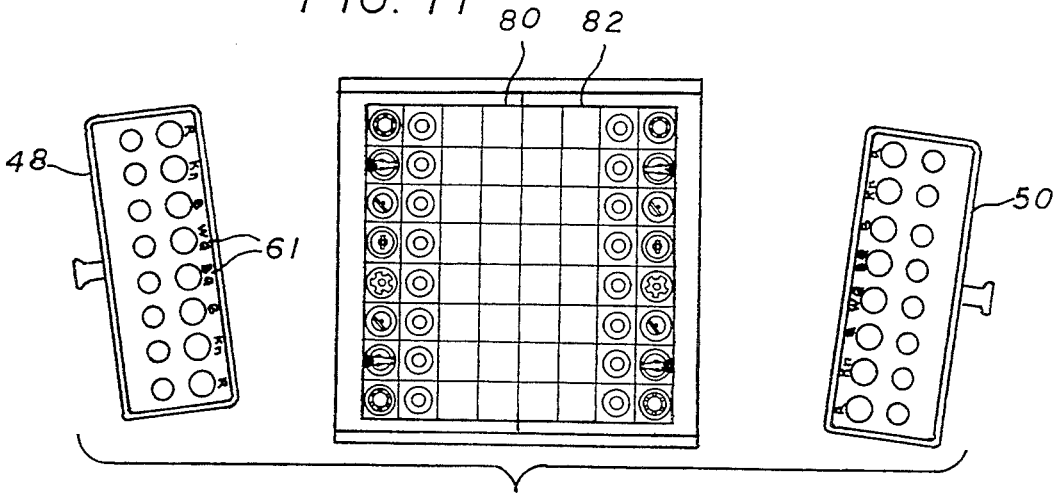
FIG. 12 is a top plan view of a self-setting chessboard game device in the playing position with the chess pieces setup on both chessboard halves and with both drawers removed.

Once board half 42 is in the locked playing position, drawer 48 is removed through depressing the triangular catch 67 on drawer lock 64, shown in FIG. 3. Drawer 48 is placed beside chess box 30 as shown in FIG. 12. The same exact operational steps are performed by the other player to place board half 44 into the playing position. When both chessboard halves 42 and 44 have been set and both drawers removed (FIG. 12), the game can proceed. Play differs from standard play only in that when a player catches one of the opponent's pieces, instead of placing it on the table top, he or she immediately redeposits it upside down into the appropriately labeled compartment in his or her drawer. By refilling the drawers in this manner, the players are in effect progressively resetting the chess box piece by piece for the next game, but not losing time doing so since the captured pieces must be deposited someplace anyway. The only exception is that sometimes chess games are ended through draws or resignations with many pieces still remaining on the chessboard. In this scenario, the players simply need to redeposit their opponents' remaining chess pieces into their drawers. Even this situation will require less work than setting up a regular chessboard from scratch since only the remaining pieces need to be transferred to the drawers.

When a game is ended and drawers 48 and 50 have been refilled with chess pieces 57, a new game can begin by resetting chess box 30. This is accomplished by placing board halves 42 and 44 back into the closed position through reversing the opening steps detailed in FIGS. 9–12, and then reinserting drawers 48 and 50 into chess box 30.

The first step to close board half 42 is to press the protruding end of locking rod 128 while pulling on board half 42 to release it from hook 140 (FIG. 11). Board half 42 is then slid back to its furthest position as in FIG. 10, and then rotated 180 degrees to the position shown in FIG. 9. At this point, board half 42 rests on flat spring 126. To lock it into the closed position as in FIG. 1, the protruding end of locking rod 128 is pressed while pushing down on board half 42. Locking rod 128 is then released which locks hook 140 into locking hole 144 as in FIG. 5B. The same exact operational steps are performed on board half 44 to place it into the closed position.

Once board halves 42 and 44 are in the closed position, drawers 48 and 50 containing inverted chess pieces 57 are reinserted into chess box 30, where chess pieces 57 automatically line up and magnetically attach to the appropriate squares of inverted board halves 42 and 44 as shown in FIG. 3. Drawers 48 and 50 are also automatically locked into place by drawer locks 64 and 66. Chess box 30 is now ready for a new game. Since each drawer contains the opponent's pieces from the last game, the black and white sides are now reversed, which is normal since players usually alternate sides after each game. Drawers 48 and 50 are interchangeable. Interchanging them will not cause chess pieces 57 to be improperly aligned.

Description Of The Second Embodiment

The second embodiment of the self-setting chessboard game device or chess box 170 is shown in FIGS. 13 through 17. Chess box 170 has two structurally identical halves, therefore only the left half in FIG. 14 of chess box 170 is described in detail. Excluding the drawers, the components of chess box 170 and chess box 30 (FIG. 1 of the first embodiment) are similar in many ways. Therefore, chess box 170 is described below in terms of its differences and similarities to chess box 30.

Figure 13:
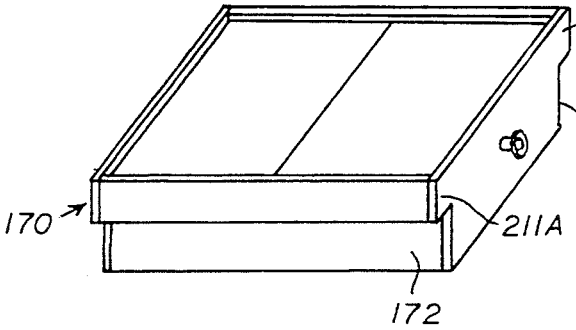
FIG. 13 is a perspective view of the second embodiment of a self-setting chessboard game device in the closed position.
Figure 15:
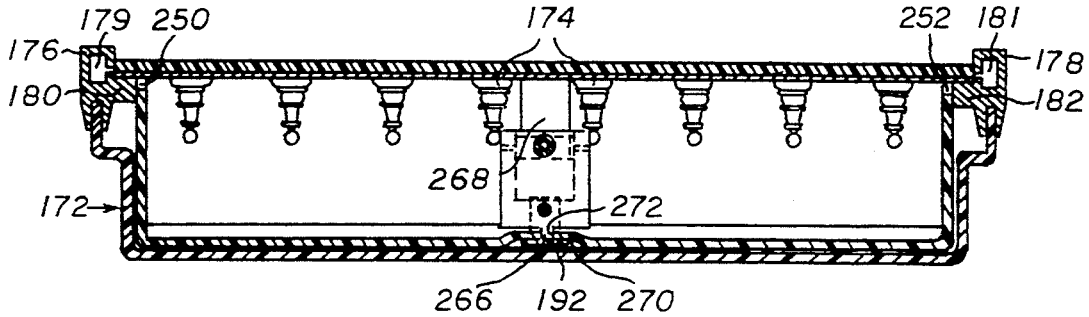
FIG. 15 is a cross sectional and cutaway view taken on lines 15—15 in FIG. 14.

In FIGS. 13 and 15, chess box 170 employs a trough 172 similar to trough 32 (FIG. 4) with the only exceptions being that trough 172 is higher to accommodate taller chess pieces 174, and trough 172 does not have rails similar to drawer rafts 60 and 62 shown in FIG. 4 also shown with dotted lines in FIG. 2. Chess pieces 174 have cylindrical magnets positioned in their bases just as chess pieces 57 in FIG. 3A. Attached to trough 172 are a pair of chess box rails or rails 176 and 178, shown in FIG. 15. They are similar to chess box rails 34 and 36 (FIG. 4) in structure, but with several exceptions. These differences are best seen by comparing FIG. 22 to FIG. 8. These exceptions are as follows: Rafts 176 and 178 do not incorporate any locking rods like locking rods 128 and 130 of chess box rails 34 and 36; also rafts 176 and 178 do not have diagonal slots such as diagonal slot 123, button recess 131, hole 132 (FIG. 5), vertical hole 136 (FIG. 8), or vertical slot 138, which are provided in chess box rails 34 and 36. Furthermore, the ledges 180 and 182 of rafts 176 and 178 (FIG. 15) do not have inner steps like inner steps 122 and 124 of chess box rails 34 and 36 (FIG. 4). Concerning similarities to chess box rafts 34 and 36, rails 176 and 178 contain channels 179 and 181 (FIG. 15), similar to channels 96 and 98 (FIG. 5) in chessboard rails 34 and 36. Channels 179 and 181 also carry a pair of bars for each side of chess box 170, similar to bars 92 and 94 of chess box 30, shown sectionally in FIG. 4. In FIG. 23, a bar 183 is shown pivotely attached to a metal chessboard shaft 186, identical to chessboard shafts 84 or 86 of chess box 30. Bar 183 slides in channel 181 of rail 178, and is different from bar 94 (FIG. 7) of chess box 30 only in that it lacks cutout 146. In the closed position of chess box 170, bar 183 as well as chessboard shaft 186 are near the middle of raft 178 as shown in FIG. 22. This is different from chess box 30, where in the closed position, bar 94 and chessboard shaft 84 are at the end of raft 36 as in FIG. 8. The result of this difference is that the opening and closing operations of chess box 170 are different from chess box 30 (see operational section).

In FIG. 22, a fragmented view of a chessboard haft or board half 184 is in the closed position of chess box 170, with its playing side 199 facing downwards. Board half 184 rests on ledges 180 and 182 as shown in FIG. 15, and in FIG. 22 for ledge 182. Board half 184 is similar in construction to board half 42 (FIG. 8) by making use of similar plastic and steel sheets and chessboard sticker. Board half 184 differs from board half 42 in terms of the position of its fixed chessboard shaft 186 (FIG. 22), and in that it does not have a locking slot such as locking slot 142, or locking hole 144 in its right side as does board half 42 in FIG. 8A. The other difference in board half 184 is the presence of grooves 206 and 208, positioned opposite from each other in the border areas on playing side 199, shown in FIG. 17 and 18A. In the closed position of chess box 170 in FIG. 22, chessboard shaft 186 is at the opposite end of board half 184 (compared to chessboard shaft 84 of board half 42 in FIG. 8), and is rotated 180 degrees so that its remaining semicylindrical portions 200 and 202 face upwards.

Figure 14:
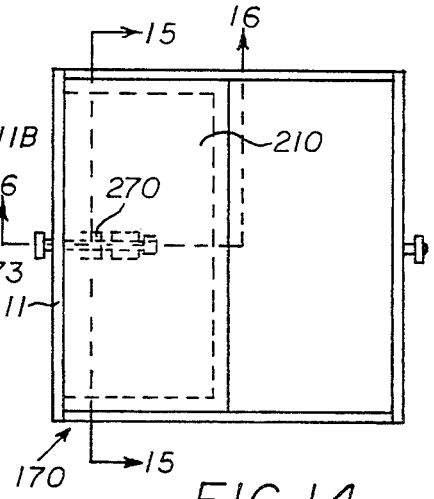
FIG. 14 is a top plan view of the embodiment of FIG. 13.
Figure 16:
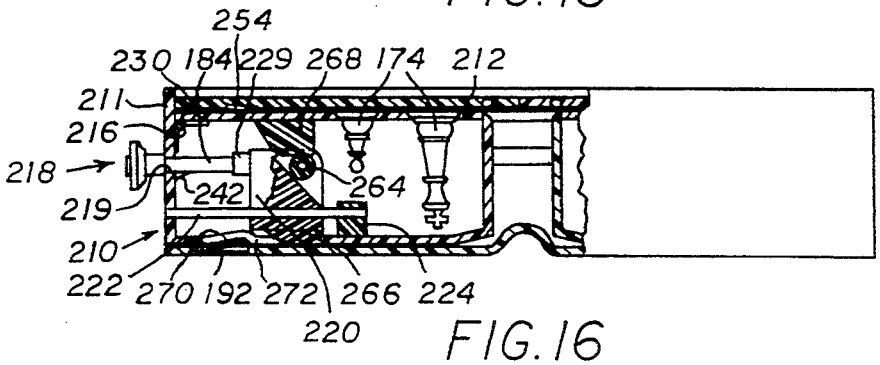
FIG. 16 is a fragmented cross sectional and cutaway view taken on lines 16—16 in FIG. 14.
Figure 16A:
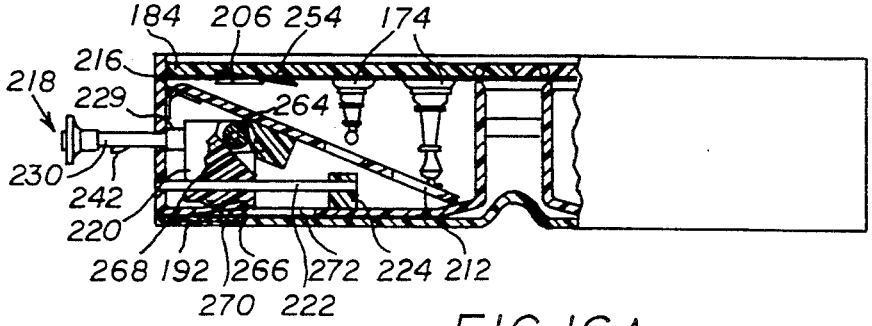
FIG. 16A is a fragmented cross sectional and cutaway view showing a chess piece holder plate lowered, taken in the same plane as FIG. 16.
Figure 16B:
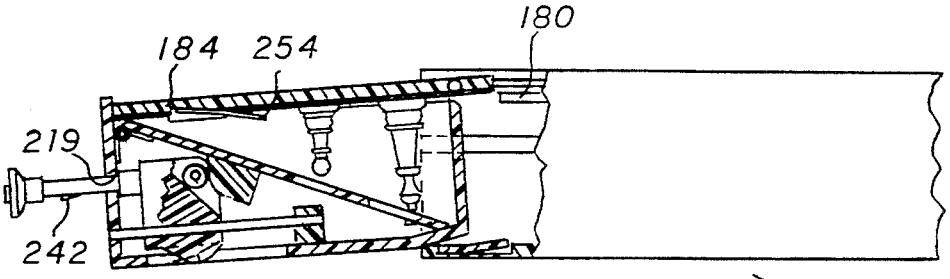
FIG. 16B is a fragmented cross sectional and cutaway view showing a drawer partially removed together with a chessboard half, taken in the same plane as FIG. 16.
Figure 16C:
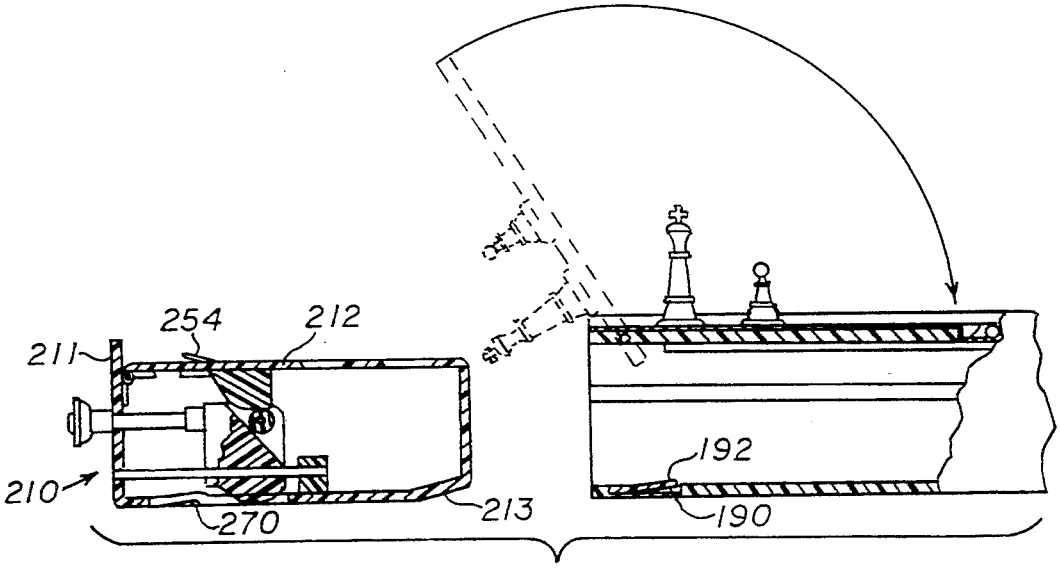
FIG. 16C is a fragmented cross sectional and cutaway view showing a drawer completely removed, and a chessboard half rotated 180 degrees by the arrow shown, taken in the same plane as FIG. 16.
Figure 17:
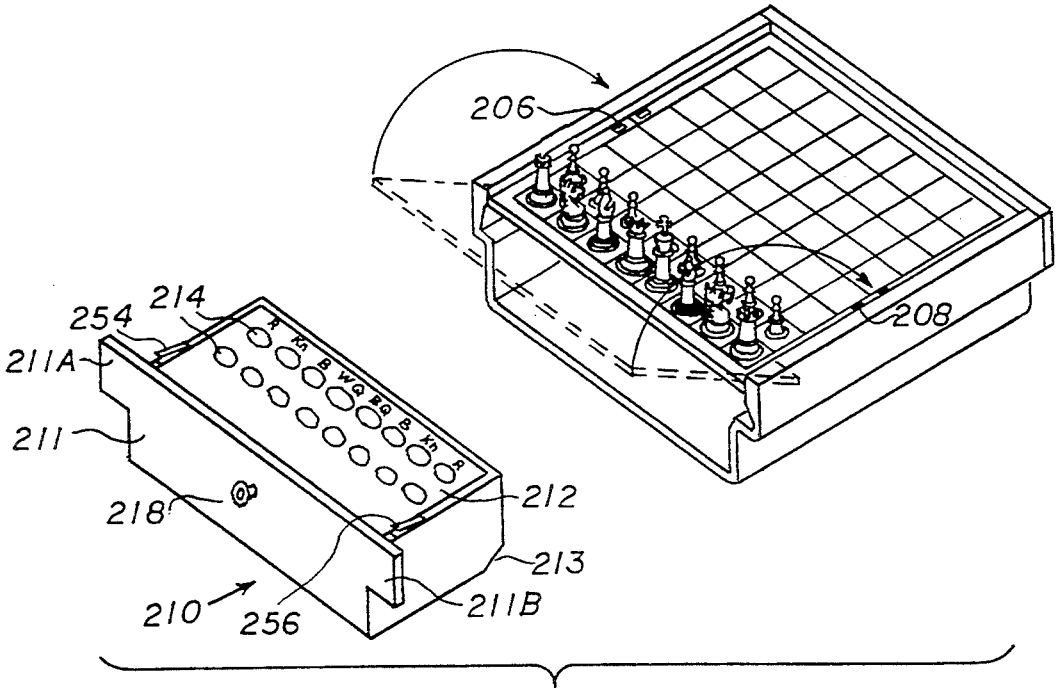
FIG. 17 is a perspective view of FIG. 16C.

A drawer 210, contained in chess box 170, is shown with dotted lines in FIG. 14, sectionally in FIG. 16, and shown removed from chess box 170 in FIG. 17. A front wall 211 of drawer 210 extends above the top surface of drawer 210, as shown in FIG. 16C. When drawer 210 is locked inside chess box 170, this extension of front wall 211 prevents board half 184 from sliding out as shown in FIG. 16. In FIG. 17, front wall 211 has extended flaps 211A and 211B on each of its sides, used to cover up the ends of rails 176 and 178 when drawer 210 is locked inside chess box 170 as in FIG. 13. The body of drawer 210 is rectangular in shape with the exception being that the bottom surface of the drawer is raised at the back to form a ramp 213 where it meets the back wall as in FIG. 16C and FIG. 17. The top surface of drawer 210 is enclosed by a lowerable chess piece holder plate or holder plate 212, shown in FIGS. 17, 18, and sectionally in FIG. 16C. Holder plate 212 contains 16 compartments 214, arranged into two rows of eight (FIG. 17), each of appropriate size to hold chess pieces 174 by their bases in an upside down position as in FIGS. 15 and 16. Compartments 214 are labeled with abbreviations in the top row for the corresponding chess pieces they hold, shown in FIG. 18. Holder plate 212 is attached to a hinge 216, which in turn is secured to the inner side of front wall 211 of drawer 210, visible in FIG. 16. Hinge 216 traverses the width of drawer 210, as shown with dotted lines in FIG. 18. In the locked position of drawer 210, hinge 216 is at 90 degrees so that holder plate 212 is parallel to the bottom surface of drawer 210 as in FIG. 16. In FIG. 16A, when drawer 210 is unlocked, hinge 216 allows holder plate 212 to rotate downward to the bottom of drawer 210, thus freeing chess pieces 174. The tops of the side walls of drawer 210 contain rectangular cutouts or cutouts 250 and 252, as shown from a top view in FIG. 18 and a side view in FIG. 18B. Cutouts 250 and 252 contain flat springs 254 and 256, secured by being pressed into diagonal slots 257 and 259 in the back corners of cutouts 250 and 252 as in FIG. 18B (not shown for slot 257). In FIG. 16 and 16A, the protruding end of flat spring 254 rests inside groove 206 of board half 184. The protruding end of flat spring 256 also rests inside groove 208 on the other side of drawer 210 (not shown). In FIG. 16B, when drawer 210 is being removed from chess box 170, the protruding ends of flat springs 254 and 256 pull board half 184 out with drawer 210, along ledges 180 and 182.

In FIG. 16, drawer 210 contains a locking handle 218. Locking handle 218 protrudes from the center of front wall 211 (FIG. 17) and has a metal tube 230 (FIG. 19), which goes through a hole 219 in the center of front wall 211, as in FIG. 16. Tube 230 is attached to a cube 220 by a flange 229, which stops locking handle 218 in an appropriate position in its unlocked pulled out state as in FIG. 16A. Locking handle 218 consists of metal tube 230 on the end of which is attached a round knob 232, shown sectionally in FIG. 19. Tube 230 contains a fixed inner tube 234. Knob 232 has a hole 236 through its center, containing a movable button 238, attached to a flat spring 240. Flat spring 240 has a thin triangular catch 242 on its free end, which protrudes out of a slot 244 contained in tube 230 when button 238 is not depressed. In FIG. 16 in the locked position of drawer 210, triangular catch 242 prevents locking handle 218 from being pulled out of hole 219 by catching wall 211. In tube 230, the space between button 238 and the opening of inner tube 234 contains a helical spring 246, shown in FIG. 19. Helical spring or spring 246 is wider in diameter than inner tube 234 to stop it from sliding into inner tube 234. When button 238 is depressed, spring 246 is compressed against inner tube 234 while triangular catch 242 is pushed out of slot 244 and slid into inner tube 234 as shown with dotted lines in FIG. 19. This action allows locking handle 218 to be pulled out of drawer 210 as in FIG. 16A. When this is done, drawer 210 is unlocked from chess box 170, and holder plate 212 is in the lowered position.

In FIG. 16A, holder plate 212 is lowered through the sliding motion of cube 220. In FIG. 21, the body of cube 220 has a triangular cutout 262 housing a roller 264. At the bottom of cube 220 there is a cam 266 attached to it as shown sectionally in FIG. 16 and perspectively in FIG. 21. Referring to FIGS. 16 and 16A, cube 220 rides along a rod 222, which is supported by the inner side of front wall 211 as well as a block 224 inside drawer 210. Rod 222 goes through a hole 226 in cube 220, shown in FIG. 21. On the bottom side of holder plate 212 is attached a supporting cam 268 shown in FIG. 15 and sectionally in FIG. 16. Supporting cam 268 has a trapezoidal profile as shown in FIG. 16. In FIG. 16C, on the bottom surface of chess box 170, there is a recess 190 which holds a flat spring 192 with a protruding end, shown sectionally. Flat spring 192 catches an indentation 270 at the bottom of drawer 210, and locks drawer 210 to chess box 170. FIG. 20 shows an enlarged portion of the bottom surface of drawer 210 containing an indentation 270 used to catch flat spring 192. Indentation 270 is visible with dotted lines from the top in FIG. 14, and from the side in FIG. 16C in drawer 210. In the locked position of drawer 210 in FIGS. 15 and 16, the protruding end of flat spring 192 is shown caught in indentation 270 preventing drawer 210 from sliding out. In FIG. 20, indentation 270 has a longitudinal cam groove 272 running through its center. Cam 266 moves in cam groove 272 as shown in FIG. 15 and 16. In FIG. 16A, when locking handle 218 is in the pulled out position, cam 266 depresses flat spring 192 out of indentation 270 thereby freeing drawer 210 to be pulled out of chess box 170 as in FIG. 16B.

Operation Of The Second Embodiment

Since chess box 170 has two identical and independently operated halves, operations for the left half only in FIG. 14 are described.

In FIG. 16, locking handle 218 is the only mechanism a player operates to lock and unlock all aspects of one side of chess box 170, including locking and unlocking holder plate 212, drawer 210, and board half 184. This is in contrast to the first embodiment where separate drawer locks and chessboard half locks are used. In the locked position of drawer 210, holder plate 212 is maintained in its elevated position by supporting cam 268 which rests with its flat head side on roller 264. When locking handle 218 is pulled out of drawer 210, cube 220 slides towards front wall 211 and its roller 264 rolls from the flat side of supporting cam 268 (FIG. 16A) to its inclined side thereby lowering holder plate 212. When unlocking drawer 210, button 238 of knob 232 is depressed while locking handle 218 is pulled out of drawer 210. In addition to lowering holder plate 212, this action unlocks drawer 210 from chess box 170 by cam 266 pushing flat spring 192 out of indentation 270. Further pulling on locking handle 218 now slides drawer 210 out of chess box 170 to its position in FIG. 16B. Flat springs 254 and 256 (FIG. 18) pull board half 184 out by its grooves 206 and 208 along with drawer 210. Board half 184 stops drawer 210 in its position in FIG. 16B since the bars attached to chessboard shaft 186 have reached the closed ends of channels 179 and 181 (not shown).

In FIG. 16C, board half 184 is now lifted off of drawer 210 by its edges, and rotated 180 degrees as shown by the arrow. Holder plate 212 is shown elevated here, but it is raised only after board half 184 has been rotated. Lowered holder plate 212 (shown in FIG. 16B) allows chess pieces 174 to be freely rotated out of drawer 210 into their playing position. Chess pieces 174 are rotated through being magnetically held to the steel sheet on board half 184 as in FIG. 16C. As board half 184 rotates, the edge closest to the axes of rotation pushes drawer 210 out of chess box 170 (FIG. 16C). Ramp 213 is provided so that drawer 210 can gradually fall off the bottom edge of trough 172, and also to facilitate the easy reinsertion of drawer 210. During the rotation of board half 184, semi-cylindrical portions 200 and 202 (FIG. 22) are contained in semi-cylindrical indentations just as in chess box 30 in the first embodiment (FIG. 8), so as to prevent sliding motion of board half 184 during rotation (See operational description of first embodiment).

Once board half 184 has been rotated into its playing position (FIG. 16C), drawer 210 (which is now removed as in FIGS. 16C and 17) needs to be relocked, that is, its holder plate 212 needs to be elevated so that chess pieces 174 can be deposited into its compartments 214 during play. Holder plate 212 is elevated by pushing locking handle 218 into drawer 210. In FIG. 16B, triangular catch 242 can be pushed through hole 219 since triangular catch 242 can recede temporarily into inner tube 234 (FIG. 19) as it passes through hole 219.

After both halves of chess box 170 have been open and set, and both drawers relocked, the game can proceed. The replacement of chess pieces 174 during play is the same procedure as that described in the operational description for the first embodiment.

When a chess game has ended and both drawers have been refilled with chess pieces 174, chess box 170 can now be reset for a new game. The first step is to slide drawer 210 into chess box 170 so that ramp 213 is positioned as shown in FIG. 16B. Now board half 184 is rotated 180 degrees onto drawer 210 below it, so that grooves 206 and 208 of board half 184 are lined up and placed over flat springs 254 and 256 of drawer 210 (as in FIG. 16B, except that holder plate 212 would be in the elevated position here). The last step is to slide the drawer (which will carry board half 184 along with it) into the locked position as shown in FIG. 16. Flat spring 192 (FIG. 16C) will be pressed into recess 190 as drawer 210 is slid into chess box 170. Flat spring 192 will automatically lock drawer 210 into chess box 170 when it once again catches indentation 270 as shown in FIG. 16.

This embodiment of the self-setting chessboard game device has several advantages over the first. The design of the second embodiment allows the use of taller chess pieces 174 than in the first embodiment without impairing the ability to release them from their holder plate 212 as shown in FIG. 16. In contrast, the ability to free the chess pieces from their holders in the design of the first embodiment necessitates using short chess pieces. In the second embodiment, the chess piece holder plates make use of simple compartments to hold chess pieces instead of the more elaborate conical compartments used in the first embodiment. The reason for this is that chess pieces of the second embodiment are freed from their holder plate before rotation as in FIG. 16B and do not require the more precise positioning that the chess pieces of the first embodiment do to clear their holders as shown in FIG. 10. Another advantage is that the surfaces of the chessboard halves in the second embodiment cannot be scratched by the dragging magnets of the chess pieces as in the first since the board halves are reinserted together with the drawers as in FIG. 16B. The second embodiment has a simplified and integrated locking mechanism in the locking handles of its drawers, which simultaneously locks a drawer inside chess box 170 and its corresponding chessboard half as locking handle 218 does in FIG. 16. In contrast, the first embodiment requires separate drawer locks and chessboard half locks. The design of the second embodiment provides a better appearance than the first since the front walls of the chess box are closed off by the drawers as in FIG. 13. In contrast, in the first embodiment, the drawers are inserted deep inside of chess box 30, and the front sides of chess box 30 appear open as shown in FIGS. 1 and 3.

Description and Operation of the Third Embodiment

Figure 24:
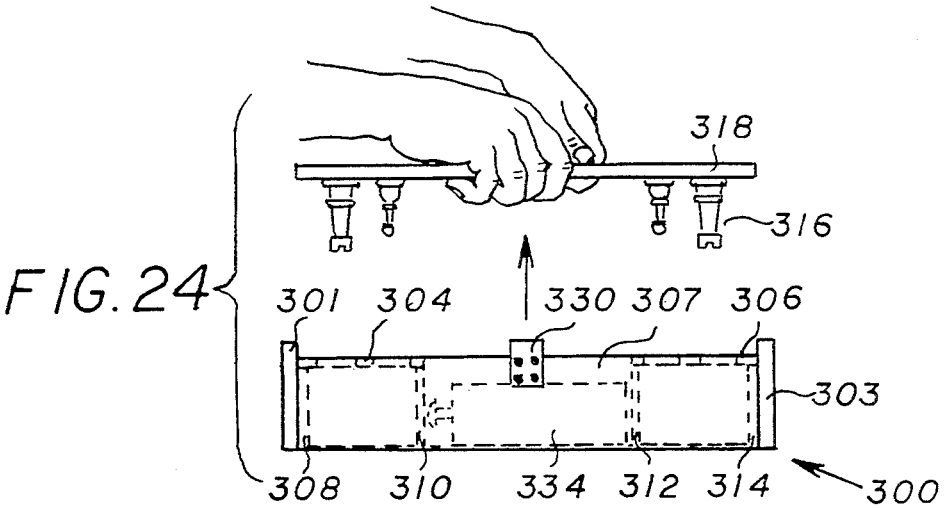
FIG. 24 is a side elevational view of the third embodiment of the present invention showing a self-setting chessboard game device with a chessboard in the upside down position being manually lifted in the direction of the indicating arrow.
Figure 26:
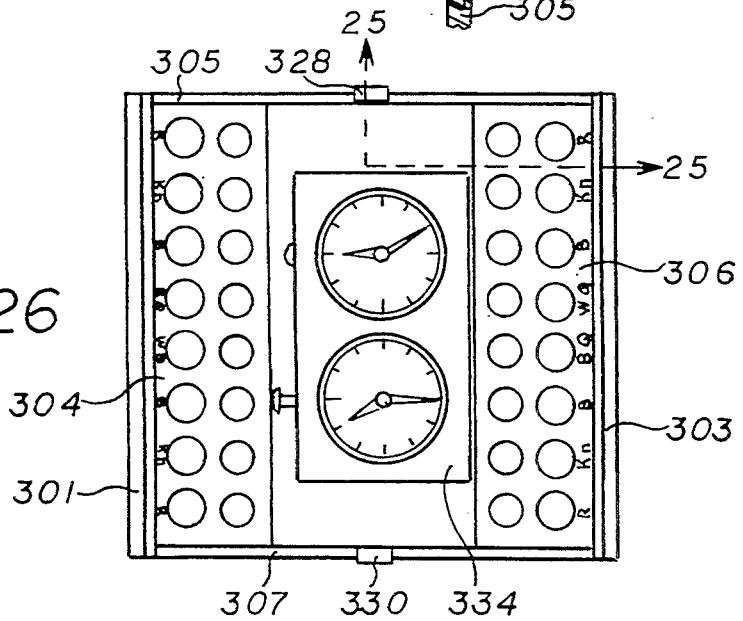
FIG. 26 is a top plan view of the third embodiment of an open self-setting chessboard game device.

The third presently preferred embodiment of the self-setting chessboard game device or chess box 300 is shown in FIG. 24. Chess box 300 consists of an open top and two elevated sides 301 and 303 as well as two supporting sides 305 and 307 as shown in FIGS. 24 and 26. Chess box 300 contains two non-removable chess piece holder plates 304 and 306 for holding chess pieces 316, as shown with dotted lines from the side in FIG. 24 and from the top in FIG. 26. Holder plate 304 is supported by walls 308 and 310, and holder plate 306 is supported by walls 312 and 314 as shown in FIG. 24. Holder plates 304 and 306 each have 16 compartments of appropriate size arranged into two rows of eight as shown in FIG. 26. The rows of compartments closest to the center of chess box 300 contain pawns, while the outer rows of holder plates 304 and 306 contain the larger chess pieces (King, Queen, Bishops, Rooks, Knights). Holder plates 304 and 306 are labeled with abbreviations for the corresponding chess pieces they hold (shown for holder plate 306) as in the previous embodiments. Chess pieces 316 are held by holder plates 304 and 306 in an upside down position by their bases (not shown) as in the previous embodiment, and have magnets positioned in their bases as shown in FIG. 3A.

Figure 27:
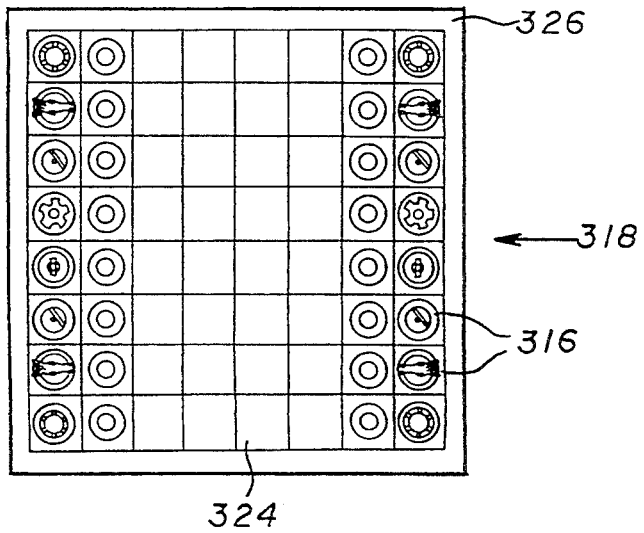
FIG. 27 is a top plan view of a chessboard with chess pieces setup for play.

In the closed position of chess box 300, its top surface is covered by a chessboard 318 which faces downwards (not shown). In FIG. 24, chessboard 318 is shown right after being lifted from the top of chess box 300. Chessboard 318 is a one piece board, not split into two halves as in the previous embodiments. Chessboard 318 consists of a square plastic sheet 320 on the surface of which is attached a steel sheet 322 of equal size, shown sectionally in FIG. 25. The chessboard pattern is displayed by a chessboard sticker 324, which covers the outer surface of steel sheet 322, as shown in FIG. 27. Chessboard sticker 324 includes the 64 checker squares which are enclosed by a border 326.

Figure 25:
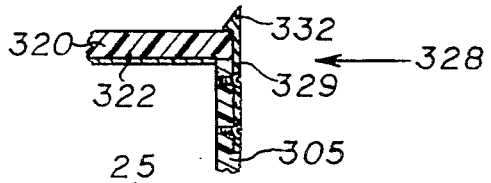
FIG. 25 is an enlarged fragmented cross sectional view of a chessboard, supporting wall, and flat spring.

Supporting sides 305 and 307 have chessboard locks 328 and 330 attached near the middle of their outer sides as shown in FIGS. 25 and 26. Chessboard lock 328 consists of a flat spring 329 which has a triangular catch 332 attached to its free end used to hold chessboard 318 in place in the closed position of chess box 300 as shown in FIG. 25. Chessboard lock 330 is identical to chessboard lock 328.

In the closed position of chess box 300, chessboard 318 rests upside down on supporting sides 305 and 307 of chess box 300 and covers holder plates 304 and 306 so that chess pieces 316 are magnetically attached upside down onto the appropriate squares of chessboard sticker 324 (not shown). To open chess box 300 and start a game, the triangular catches of chessboard locks 328 and 330 are pushed outwards while lifting chessboard 318 as in FIG. 24. Since chess pieces 316 are magnetically attached to steel sheet 322, this action lifts all the chess pieces out of holder plates 304 and 306. Chessboard 318 with all pieces set in place is then rotated 180 degrees by hand, and placed on a table top next to empty chess box 300. Holder plates 304 and 306 are not removable as they are with the drawers in the previous two embodiments, but remain in chess box 300 where chess pieces 316 are deposited upside down during play similarly as in the previous two embodiments. When a game is finished and all chess pieces 316 have been replaced into holders 304 and 306, chessboard 318 is then placed upside down over chess box 300 while pushing the triangular catches of chessboard locks 328 and 330 outwards to allow chessboard 318 to descend onto supporting walls 305 and 307 as in FIG. 25 in the locked position. Chess box 300 is now ready for another game. The center of chess box 300 has empty space inside as shown in FIG. 26, and can be used to hold a chess clock 334 for example, or other objects.

This embodiment of the self-setting chessboard game device has the advantage over the previous two in that it is much simpler in design, and does not require a split chessboard or removable drawers. Also each side is not independently operated, but both sides of the chessboard are setup together through the lifting operation shown in FIG. 24. In addition, chessboard 318 is removable from chess box 300, and rests on a tabletop as a conventional thin chessboard. Also, the rows of compartments in holder plates 304 and 306 are positioned so they correspond to the normal position of chess pieces on a chessboard (with the exception of the positions of the black and white queens being reversed), while in the previous embodiments, the rows are reversed.

Description And Operation Of The Fourth Embodiment

Figure 28:
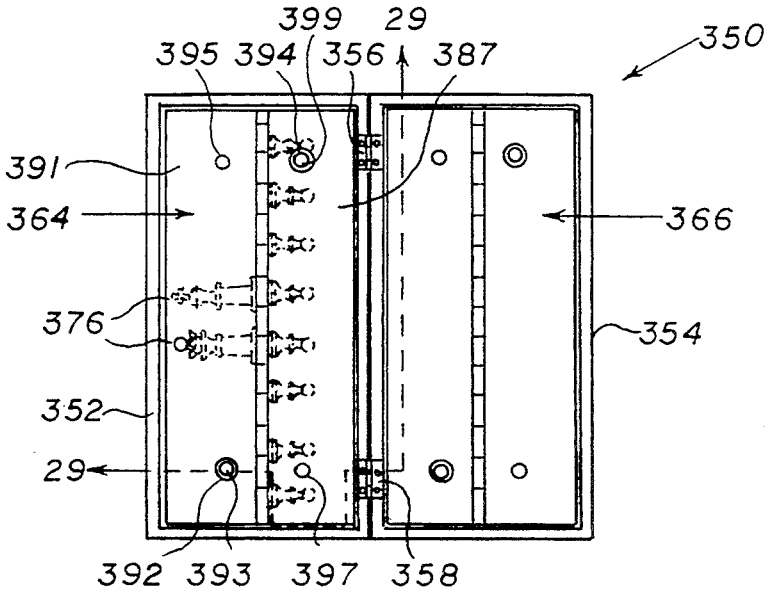
FIG. 28 is a top plan view of the fourth embodiment of the self-setting chessboard game device in an open position.
Figure 31:
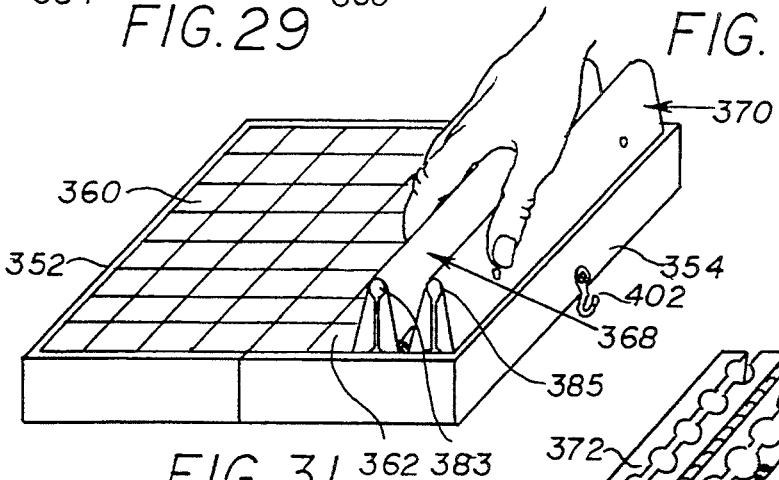
FIG. 31 is a perspective view of an open chess box with a chess piece holder on its surface.
Figure 32:
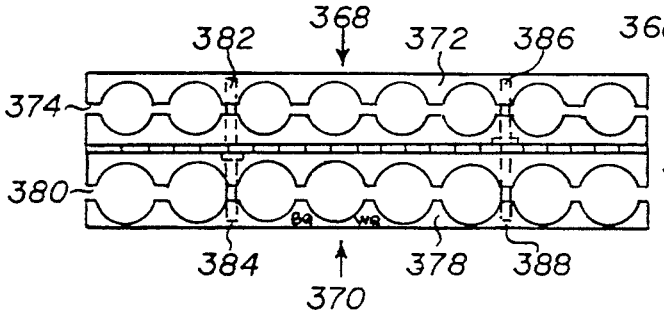
FIG. 32 is a top plan view of the compartments of an open chess piece holder in the standing position.
Figure 33:
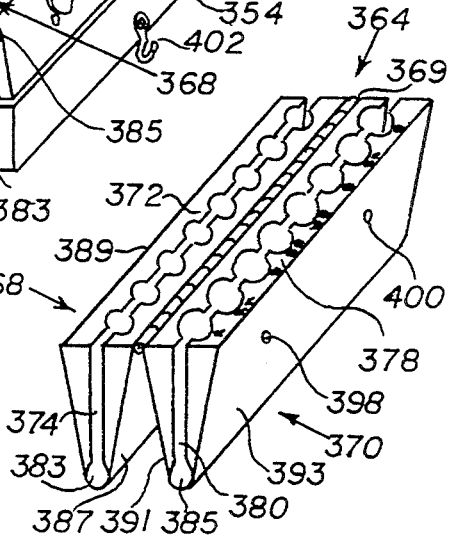
FIG. 33 is a perspective view of an open chess piece holder in its standing position.

The fourth embodiment of the self-setting chessboard game device or chess box 350 is shown open in FIG. 28 in a top plan view. Chess box 350 is foldable and consists of two similar box halves 352 and 354, hinged together by hinges 356 and 358 as shown in FIG. 28. Box half 354 has a hook 402 on one of its side walls as shown in FIG. 31, which locks to box half 352 when box halves 352 and 354 are folded together along hinges 356 and 358 into the closed position of chess box 350 (not shown). The chessboard surfaces 360 and 362 of box halves 352 and 354 each carry half of the chessboard pattern. Box halves 352 and 354 contain identical chess piece holders 364 and 366 shown in their closed state in FIG. 28, and shown sectionally for holder 364 in FIG. 29. Holders 364 and 366 are held in box halves 352 and 354 by means of friction. In FIG. 33, holder 364 is shown empty in its open standing position. Holder 364 consists of two hollow wedge-shaped troughs 368 and 370 of equal size, each formed by inner and outer walls 387, 389 and 391, 393 as shown in FIG. 33. Troughs 368 and 370 are made preferably of thin flexible plastic material. Inner and outer walls 387 and 389 of trough 368 converge together and form a rounded edge 383 that traverses their length, and are separated at all other points to form slot 374. Inner and outer walls 391 and 393 of trough 370 also converge together to form a similar rounded edge 385, and also are separated at all other points to form slot 380. The rounded edges 383 and 385 of troughs 368 and 370 provide flexibility and function as flat springs to allow slots 374 and 380 to expand. This spring action of rounded edges 383 and 385 is employed in the mechanism for releasing the chess pieces as described in detail below. Inner walls 387 and 391 of troughs 368 and 370 are held together by a hinge 369 which spans their length. Hinge 369 allows holder 364 to be folded into a closed position as in FIG. 29. Troughs 368 and 370 have chess piece holder plates 372 and 378 across the tops of their inner and outer walls as shown in FIGS. 32 and 33. Holder plates 372 and 378 each have a row of eight compartments and are split in the middle by slots 374 and 380. Holder plate 372 is used to contain the pawns of chess pieces 376, and holder plate 378 contains the other larger chess pieces as partially shown with dotted lines in FIG. 28, where holder 364 is in the closed position. Holder plate 378 is labeled with abbreviations for the corresponding chess pieces it holds, visible in FIGS. 32 and 33. In FIG. 33, chess pieces 376 are deposited during play into the appropriate compartments of holder plates 372 and 378 in an upside down position as in the previous embodiments, where they are held in place. The inside surfaces of the inner and outer walls 387, 389 and 391, 393 of troughs 368 and 370 are lined with a felt material 381 (shown sectionally for through 370 in FIG. 29) to more securely hold chess pieces 376, and to prevent them from being scratched.

Figure 29:
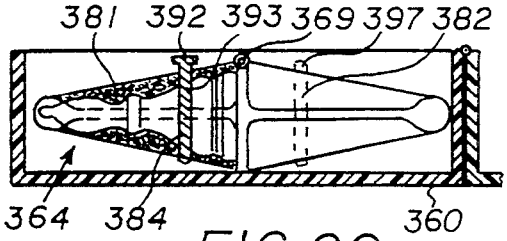
FIG. 29 is a cross sectional and cutaway view taken along lines 29—29 in FIG. 28.
Figure 30:
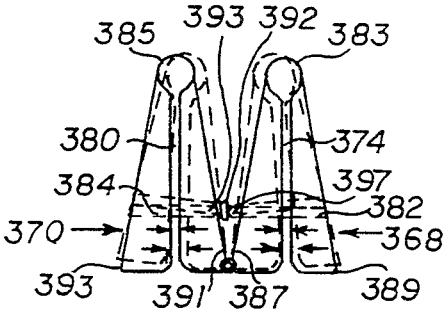
FIG. 30 is a side plan view of an open chess piece holder.

Troughs 368 and 370 contain rods 382, 386 and 384, 388, passing across them as shown in FIG. 32. Rods 382 and 384 are also shown in FIG. 29 and 30. Rods 384 and 388 of trough 370 are attached by one of their ends to the inside of outer wall 393 at points 398 and 400 as shown in FIG. 33. Rods 382 and 386 of trough 368 are also attached by one of their ends to the inside of outer wall 389 at the same level as points 398 and 400 (not shown). Rods 384 and 388 protrude through holes in inner wall 391 to form free ends 393 and 395 as shown in FIG. 28. Rods 382 and 386 also protrude through holes in inner wall 387 to form free ends 397 and 399. Free ends 393 and 399 have flanges 392 and 394 attached to them as shown in FIG. 28, and shown for free ends 393 and 397 in FIGS. 29 and 30.

When chess box 350 is opened as in FIG. 28, holder 364 is removed through lifting by means of flanges 392 and 394 which function as handles. Holder 364 is then opened along hinge 369 while in the air into the position in FIG. 30, by pushing together the rounded edges 383 and 385 of troughs 368 and 370 as shown in FIG. 31. Holder 364 is then positioned over chessboard surface 362 of box half 354 (or equivalently over chessboard surface 360) as shown in FIG. 31, lining up troughs 368 and 370 over their rows of corresponding squares. Chess pieces 376 are released from troughs 368 and 370 by squeezing together their rounded edges 383 and 385 as in FIGS. 30 and 31. This pressure causes the rods' free ends 393 and 395 to push against free ends 397 and 399 as shown for free ends 393 and 397 in FIG. 30. This results in inner and outer walls 387, 389 and 391, 393 to assume the new position shown with dotted lines in FIG. 30, where inner walls 387 and 391 have moved inwards, increasing the widths of slots 374 and 380 as shown by the arrows, which allows chess pieces 376 to be released onto chessboard surface 362 as in FIG. 31. Holder 364 is then freely lifted and placed on a tabletop so that it stands on the rounded edges 383 and 385 of its troughs as in FIG. 33. Chess pieces 376 are deposited upside down during a game into holders 364 and 366, and when they both have been refilled, they are closed by rotating their troughs along their hinges into a flat position as in FIG. 29, and placed into box halves 352 and 354 as in FIG. 28.

This embodiment of the self-setting chessboard game device has several advantages over the previous three: In contrast to the previous three embodiments where chess pieces are stored vertically in the chess boxes, chess pieces of the fourth embodiment are stored in a horizontal position when inside chess box 350, allowing the chess box to be smaller by being a conventional foldable-type chess game box; Chess pieces with magnets in their bases are not required for the setting process, allowing the surface of the chessboard to be of a wider variety of material (of course a magnetic set could be prodded as an option); The design of the holders of the fourth embodiment are particularly well suited for use with small chess pieces and chessboards, including portable chessboards.

Description and Operation of the Fifth Embodiment

Figure 34:
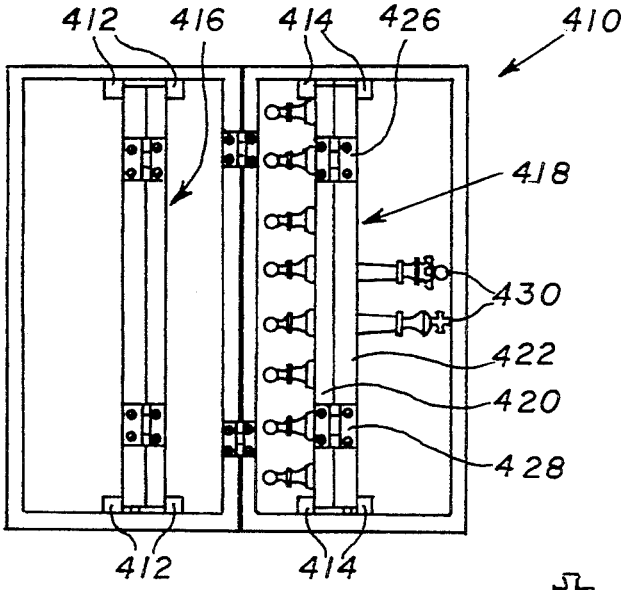
FIG. 34 is a top plan view of the fifth embodiment of the self-setting chessboard game device in an open position.

The fifth embodiment of the self-setting chessboard game device or chess box 410 is shown open in FIG. 34 in a top plan view. This embodiment is similar in many ways to the fourth embodiment, although there are some essential differences which provide certain advantages.

Figure 35:
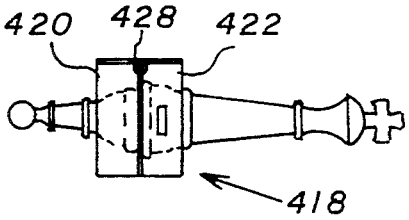
FIG. 35 is a side view of a closed chess piece holder containing chess pieces.
Figure 36:
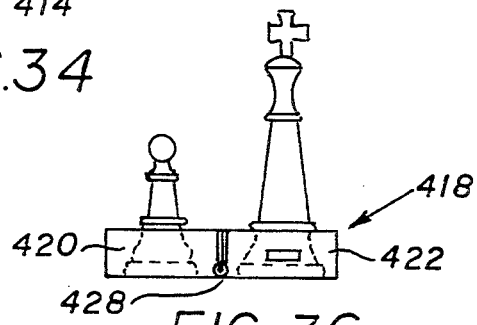
FIG. 36 is a side view of an opened chess piece holder containing chess pieces.

As in the fourth embodiment, the fifth embodiment of the self-setting chessboard game device also employs foldable chess piece holders 416 and 418 which store chess pieces 430 in a horizontal position when inside a foldable chess box 410 as shown in FIG. 34. Holders 416 and 418 are identical. Chess box 410 is similar to chess box 350 of the fourth embodiment, with the only difference being that chess box 410 contains guides 412 and 414 which are used to position and hold chess piece holders 416 and 418. Holder 418 has a rectangular shape and is divided along its length into two holder halves 420 and 422 of equal size, held together by hinges 426 and 428, shown in FIGS. 34, 35, and 36. Each holder half 420 and 422 contains a row of eight compartments 421 and 423 (FIG. 40) for holding chess pieces 430. Holder half 422 of holder 418 is shown sectionally in FIG. 38, containing a slot 440 running horizontally through its length. The other holder half 420 of holder 418 also has a similar slot (not shown). Holder 418 is shown in the closed position in FIG. 35, where holder halves 420 and 422 are folded against each other by hinges 426 and 428. In FIG. 36 holder 418 is shown in its open or unfolded position. Holder half 420 contains the pawns of chess pieces 430 while holder half 422 contains the other larger chess pieces. Holder half 422 is labeled with abbreviations for the corresponding chess pieces it contains as shown in FIG. 40. Chess pieces 430 are deposited fightside up during play into the compartments of holders 416 and 418, as shown for holder 418 in FIG. 36. Holder half 422 of holder 418 is shown in an enlarged, fragmented and cutaway view in FIG. 37. Slot 440 of holder half 422 contains a locking fork 432 which has 16 protrusions 436, eight on the inner side of each arm corresponding to the positions of compartments 423 as shown in FIG. 40. One end of locking fork 432 forms a button 434 and protrudes out of a hole 433 in an end of holder half 422 as shown in FIGS. 37 and 40. The other end of holder half 422 contains a flat spring 438 inside of slot 440 attached such that both arms of locking fork 432 push against it when button 434 is pressed, making locking fork 432 spring loaded, as shown in FIG. 37. Holder half 420 has an identical spring loaded fork in its slot with a button 437 shown in FIG. 40. When chess pieces 430 reside in the compartments of holder half 422 and button 434 is not depressed, they are held in place by protrusions 436, which overlap with the compartments of holder half 422. When button 434 is depressed, locking fork 432 moves to the position shown with dotted lines in FIG. 37, and protrusions 436 move out of the compartments of holder half 422, thus releasing chess pieces 430. Protrusions 436 are of a rubber material so as not to damage chess pieces 430 when holding them.

When starting a game, holder 418 is placed over its corresponding rows of squares on chess box 410 as shown in FIG. 39, and buttons 434 and 437 are depressed to release chess pieces 430. Holder 418 is then lifted up over chess pieces 430 and placed on the tabletop as in FIG. 40. During play, when the captured chess pieces are deposited into compartments 421 and 423 of holder 418, they are placed on top of the overlapping protrusions. When holder 418 has been filled, buttons 434 and 437 of both holder halves are momentarily depressed to allow the chess pieces to fall through the compartments to the level of the tabletop below. The chess pieces are now securely locked in place. Before closing chess box 410, holder 418 is folded as in FIG. 35 and replaced into chess box 410, where it is securely held by either guides 412 or 414 as in FIG. 34. Holder 416 is similarly operated as holder 418.

This embodiment has several advantages over the fourth embodiment: Larger chess pieces can be stored in holders 416 and 418 when inside chess box 410 (FIG. 34) than in the fourth embodiment, where space is wasted on the pawn sides of the folded holders as shown in FIG. 28; in the fifth embodiment, chess pieces are deposited in an upright position during play into holders 416 and 418 which allows the players to more easily keep track of the captured pieces than in the fourth embodiment, where captured chess pieces are deposited upside down in their holders and are hidden; Holders 416 and 418 of the fifth embodiment are much smaller and are less noticeable on the tabletop than the holders of the fourth embodiment; The design of the holders of this embodiment are well suited for large size chess pieces and chessboards.

I claim:

1. A game apparatus adapted for positioning a predetermined number of game pieces on a game board, comprising:

a single housing having a plurality of compartments for receiving all of said game pieces therein, said compartments can be gradually filled as said game pieces are gradually removed from said game board during game play, so that when said compartments are filled with said game pieces, including said game pieces that remain on said game board after a game, said housing can be positioned against said game board for simultaneously positioning all of said game pieces thereon.

2. The game apparatus of claim 1 wherein said game pieces have an upright orientation during game play, and are placed inverted into said compartments.

3. The game apparatus of claim 2, further including attaching means for attaching the inverted game pieces to said game board when said game board is inverted from a normal upright orientation.

4. The game apparatus of claim 3 wherein said attaching means comprises a magnet disposed within each said game piece, and said game board being made of a magnetically attractive material, so that said game pieces can be magnetically attached to said game board.

5. The game apparatus of claim 1 wherein said housing includes a pair of spaced apart game piece holders, and said compartments are evenly distributed thereon.

6. The game apparatus of claim 1 wherein said compartments are generally round for receiving said game pieces.

7. The game apparatus of claim 1 wherein said game board comprises a chess board, and said game pieces comprise chess pieces.

8. The game apparatus of claim 1 wherein said compartments in said holder are labeled to identify the appropriate game pieces that they hold.

9. A self-setting game board apparatus, comprising:

a base, a game board adapted for supporting a plurality of game pieces thereon, said game pieces and said game board each having an upright orientation during game play, pivot and rail means mounting the game board on the base for pivotal movement about a horizontal axis and for sliding movement relative to the base, a game piece holder having a plurality Of compartments for receiving said game pieces, and attaching means for attaching said game pieces to said game board, whereby when said game piece holder is filled with said game pieces and said game board is pivoted upside down over said game piece holder, said attaching means will attach said game pieces to the upside down game board, and when said game board is pivoted rightside up and slid in relation to the base, said game pieces will be attached upright on said game board.

10. The self-setting game board apparatus of claim 9, further including means for slidably and removably fitting said game piece holder under said game board, whereby when said game piece holder is removed from under said game board, said game piece holder can be gradually filled as said game pieces are gradually removed from said game board during play, and when said game piece holder is filled with said game pieces, including said game pieces that remain on said game board after a game, said game piece holder can be slidably fitted under said game board, so that said attaching means can attach said game pieces to said game board.

11. The self:setting game board apparatus of claim 9, further including a spring disposed under said game board for partially pivoting said game board.

12. The self-setting game board apparatus of claim 9 wherein each of said pivots comprises a rod extending from said game board, said rod includes a semi-cylindrical gap, each of said rails includes an indentation for partially receiving said rod, so that said game board can be slid along said rail only when said semi-cylindrical gap is rotationally positioned for receiving said rail.

13. The self-setting game board apparatus of claim 9 wherein said attaching means comprises a magnet disposed within each said game piece, and said game board being made of a magnetically attractive material, so that said game pieces can be magnetically attached to said game board.

14. A self-setting game board apparatus, comprising:

a game board adapted for supporting a plurality of game pieces thereon, attaching means for attaching said game pieces to said game board, means mounting the game board for pivotal movement about a horizontal axis between a playing position and an inverted position, a game piece holder having a plurality of compartments for receiving said game pieces, and means mounting the game piece holder for pivotal movement about a horizontal axis between a holding .position immediately beneath the inverted game board with the holder in holding engagement with game pieces on the under side of the board and a lowered position in which the holder is disengaged from the game pieces On the under side of the inverted board.

15. The self-setting game board apparatus of claim 14, further including means for slidably and removably fitting said game piece holder under said game board, whereby when said game piece holder is removed from under said game board, said game piece holder can be gradually filled as said game pieces are gradually removed from said game board during play, and when said game piece holder is filled with said game pieces, including said pieces that remain on said game board after a game, said game piece holder can be slidably fitted under said game board, so that said attaching means can attach said game pieces to said game board.

16. The self-setting game board apparatus of claim 15, further including a rail for slidably receiving said pivot, so that said game board can be slid and pivoted along said rail for alternately being positioned rightside up and upside down.

17. The self-setting game board apparatus of claim 16 wherein said pivot comprises a rod extending from said game board, said rod includes a semi-cylindrical gap, said rail includes an indentation for partially receiving said rod, so that said game board can be slid along said rail only when said semi-cylindrical gap is rotationally positioned for receiving said rail.

18. The self-setting game board of claim 16, further including means for causing said game board to slide along said rail when said game piece holder is slidably removed from said game board apparatus.

19. The self-setting game board apparatus of claim 14 wherein said attaching means comprises a magnet disposed within each said game piece, and said game board being made of a magnetically attractive material, so that said game pieces can be magnetically attached to said game board.

20. A self-setting game board apparatus, comprising:

a game board adapted for supporting a predetermined number of game pieces thereon, said game pieces and said game board each having an upright orientation during game play, attaching means for attaching said game pieces to said game board, and a single housing having a plurality of compartments for receiving all of said game pieces inverted, whereby when said game pieces are received in said compartments, said game board can be inverted and placed over said housing, so that said attaching means will attach the inverted game pieces to the inverted game board, and when said game board is lifted from said housing, all of said game pieces will be lifted simultaneously therefrom, and when said game board is placed upright, said game pieces will be supported upright on said game board.

21. The self-setting game board apparatus of claim 20, further including storage space for storing a chess clock.

22. The self-setting game board apparatus of claim 20 wherein said attaching means comprises a magnet disposed within each of said game pieces, and said game board being made of a magnetically attractive material, so that said game pieces can be magnetically attached to said game board.

23. A game apparatus adapted for positioning a plurality of game pieces on a game board, comprising:

a game piece holder having a plurality of compartments arranged in a plurality of rows for receiving said game pieces, said game piece holder being hinged along a line between two of said rows for movement between a storage position in which all of said game pieces lie on their sides in a common horizontal plane and a setting position in which all of said game pieces are upright for placement on said game board.

24. The game apparatus of claim 23 wherein said compartments comprise cooperating cavities in two parallel and hingably connected walls spreadable for receiving and holding said game pieces.

25. The game apparatus of claim 24, further including spreading means for spreading apart said walls for releasing said game pieces.

26. The game apparatus of claim 24 wherein said walls are conjoined with a flexible material, so that said walls tend to stay closed for holding said game pieces therebetween, but can be easily spread apart for releasing said game pieces therefrom.

27. A game apparatus adapted for positioning a plurality of game pieces on a game board, comprising:

a game piece holder for receiving said game pieces in a plurality of compartments, said game piece holder including an elongated locking member having a plurality of protrusions protruding into corresponding compartments, and a spring for urging said locking member and said protrusions into engagement with said game pieces for securely locking said game pieces in said compartments, whereby when said game pieces are locked in said compartments, said game piece holder can be placed on said game board, and said locking member can be moved against said spring for disengaging said protrusions from said game pieces for releasing said game pieces onto said game board.

28. The game apparatus of claim 27 wherein said spring comprises a leaf spring.

29. The game apparatus of claim 27 wherein said protrusions are made of rubber.

30. The game apparatus of claim 27 wherein said game piece holder holds said game pieces in a plurality of rows, said game piece holder being foldable along a line between two of said rows between a flat storage position in which all of said game pieces lie on their sides in a common horizontal .plane and a folded setting position in which all of said game pieces are upright for placement on said game board.

31. A method for automatically resetting a game board with a predetermined number of game pieces thereon, comprising the steps of:

(a) providing a single housing having a plurality of compartments for receiving all of said game pieces therein, (b) gradually depositing said game pieces in said compartments as said game pieces are gradually removed from said game board during game play, and (c) placing said housing against said game board when said compartments are filled with said game pieces, including the game pieces that remain on said game board after a game, whereby said game pieces are reset onto said game board.

32. A self-setting game board apparatus, comprising:

a game board adapted for receiving a plurality of game pieces thereon, said game pieces and said game board each having an upright orientation during game play, a game piece holder having a plurality of compartments for receiving said game pieces therein, and housing means for slidably receiving said game piece holder therein and sized for supporting said game board thereon, so that when said game piece holder is slidably fitted within said housing means, said game piece holder is positioned under said game board, whereby when said game board is supported upside down on said housing means, and said game piece holder is holding said game pieces and slidably fitted in said housing means, said game pieces are positioned directly under said game board, so that when said game board, said housing means, and said game piece holder are all turned over together, said game pieces are supported on top of said game board.

* * * * *